US007438307B2

(12) United States Patent
Damiani et al.

(10) Patent No.: US 7,438,307 B2
(45) Date of Patent: Oct. 21, 2008

(54) SAFETY BINDING

(75) Inventors: Laurent Damiani, Villaz (FR); Pierre Desarmaux, Evires (FR); Christian Brunet, Annecy (FR); Pierre Jean Arnoux, Annecy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 11/583,093

(22) Filed: Oct. 19, 2006

(65) Prior Publication Data

US 2007/0090626 A1 Apr. 26, 2007

(30) Foreign Application Priority Data

Oct. 20, 2005 (FR) ..... 05 10723

(51) Int. Cl.
*A63C 9/00* (2006.01)
*A63C 9/08* (2006.01)

(52) U.S. Cl. ..... 280/611; 280/612; 280/613; 280/616; 280/618; 280/626; 280/628; 280/629; 280/631

(58) Field of Classification Search ..... 280/611, 280/612, 613, 616, 618, 626, 628, 629, 631
See application file for complete search history.

(56) References Cited

U.S. PATENT DOCUMENTS 3,762,735 A * 10/1973 Smolka ..... 280/612
3,940,156 A * 2/1976 Marker ..... 280/611
4,135,733 A 1/1979 Salomon
4,291,894 A * 9/1981 D'Antonio et al. ..... 280/612
4,385,773 A * 5/1983 Scheck et al. ..... 280/612
4,387,307 A * 6/1983 D'Antonio ..... 307/119
4,415,176 A * 11/1983 Hull et al. ..... 280/612
4,436,321 A * 3/1984 Storandt et al. ..... 280/612
4,457,532 A * 7/1984 Knabel ..... 280/612
4,458,157 A * 7/1984 Knabel et al. ..... 307/119
4,482,168 A * 11/1984 Oberleitner ..... 280/612
4,494,768 A * 1/1985 Hull ..... 280/612
4,516,791 A * 5/1985 Riss et al. ..... 280/612
4,572,539 A * 2/1986 Salomon ..... 280/611
5,040,819 A * 8/1991 Horn ..... 280/618
5,064,215 A * 11/1991 Ferdinand et al. ..... 280/612

(Continued)

FOREIGN PATENT DOCUMENTS

FR 2 354 787 A1 1/1978

*Primary Examiner*—Christopher Ellis
*Assistant Examiner*—John R Olszewski
(74) *Attorney, Agent, or Firm*—Greenblum & Bernstein, P.l.C.

(57) ABSTRACT

A safety binding device for binding a boot on an alpine ski including a releasable retaining mechanism of the mechanical, hydraulic, viscoelastic type, which actuate a release as a function of the forces to which the boot is subjected and as a function of the duration Δt of the application of such forces. The release action occurs as soon as the magnitude of the force is greater than an actual release threshold, Sr, which is dependent upon the duration Δt of the application of force, such that if duration is greater than one second, the actual release threshold is between 50% and 75% of the theoretical release threshold, St, whereby: $\Delta t>1$ s; $0.75\times St \geqq Sr(\Delta t) \geqq 0.5\times St$, with the theoretical release threshold St being determined as a function of the skier's parameters in conformance with ISO standards. In a particular embodiment, the release principle, which defines the actual release threshold as a function of the duration, Sr (Δt), is of the exponential decrease type: $Sr(\Delta t)=a+\exp[(b-\Delta t)/c]$; whereby a, b, and c are parameters.

12 Claims, 3 Drawing Sheets

U.S. PATENT DOCUMENTS 5,411,283 A * 5/1995 Nowak et al. ..... 280/618
5,957,478 A * 9/1999 Vigny ..... 280/615
6,007,086 A * 12/1999 Hopkins ..... 280/612
2003/0178813 A1* 9/2003 Battistella et al. ..... 280/629

* cited by examiner

SAFETY BINDING

CROSS-REFERENCE TO RELATED APPLICATION

This application claims priority under 35 U.S.C. §119 of French Patent Application No. 05.10723, filed on Oct. 20, 2005, the disclosure of which is hereby incorporated by reference thereto in its entirety.

BACKGROUND OF THE INVENTION

1. Field of the Invention

The invention relates to a safety binding device for binding a boot to a gliding board, the binding device including releasable retaining elements.

2. Description of Background and Relevant Information

Safety bindings having a toe piece and a heel piece to hold a ski boot therebetween are known from the prior art. Such safety bindings disengage and release the ski boot when the toe piece and the heel piece are subjected to forces that exceed a certain threshold. The release threshold can be changed by adjusting the pre-tensioning of the springs positioned in the toe piece and the heel piece. In an essentially mechanical binding, such as that described herein, the actual release of the binding is not significantly dependent upon the duration of the application of forces transmitted between the ski boot and the ski. The lack of dependency of the release of the boot on the duration of the application of forces can increase the risks taken by the skier. It is known that relatively substantial forces applied for a very short period of time pose no danger to the skier. However, if the binding device release principle does not take into account the duration of the application of forces, or does so inadequately, the binding will release and therefore cause the skier to fall as soon as a substantial force is applied, even for a very short period of time. This type of release, undesirable for the skier's safety, even potentially dangerous, is referred to as an ill-timed release. This is especially the case when the skier skis at high speed. In practice, to overcome this drawback, skiers, particularly racers, adjust the bindings to very high release values, for example DIN 15 or DIN 20. Under these circumstances, the skier assumes the risks involved when he/she skis at lower speeds. In addition, it is known that the human body can sustain serious injuries, even when subjected to low forces, provided that these forces are applied to the body for relatively long periods of time. For example, after a fall, when the skier has stopped, the forces to which the skier's leg is subjected can be minimal to the point of not reaching the release value set on the binding, but can last more than several seconds. In such a situation, the skier may be injured if he/she cannot manually actuate the release.

SUMMARY OF THE INVENTION

The invention proposes a safety binding device for binding a boot onto a gliding board, which makes it possible to overcome the limitations of the known prior art devices.

A safety device for binding a boot to an alpine ski, according to the invention, includes releasable retaining mechanisms of the mechanical, hydraulic, or viscoelastic type which actuate a release as a function of the forces to which the boot is subjected, whereby the moment during which such release action occurs is also a function of the duration Δt of the application of forces to the boot.

In a particular embodiment, the safety binding device according to the invention includes an arrangement to detect the forces to which the boot is subjected when retained by the releasable retaining mechanisms, as well as an electronic circuit controlling the release action of the releasable retaining mechanism by generating a release signal as a function of the detected value of the forces and the duration Δt of the application of forces to the boot.

In a particular the binding device according to the invention, the release action occurs as soon as the magnitude of the force E is greater than an actual release threshold Sr, the latter depending upon the duration of the application of forces, so that if the duration of application, Δt, is greater than one second, 1 s, the actual release threshold, Sr (Δt), ranges between 50% and 75% of the theoretical release threshold St, whereby:

$$\Delta t > 1\text{ s};\ 0.75\times St \geqq Sr(\Delta t) \geqq 0.5\times St,$$

the theoretical release threshold, St, being determined as a function of the skier's parameters in conformance with the ISO standards.

Furthermore, in the binding device according to the invention, the release action occurs as soon as the magnitude of the force is greater than an actual release threshold Sr, the latter depending on the duration of the application of a given force, so that if the duration of application is less than or equal to 5 hundredths of a second, 0.05 s, the actual release threshold, Sr, is greater than or equal to 150% of the theoretical release threshold, St, whereby:

$$\Delta t \leqq 0.05\text{ s};\ Sr(\Delta t) \geqq 1.5\times St,$$

the theoretical release threshold, St, being determined as a function of the skier's parameters in conformance with the ISO standards.

Also according to the invention, a method is provided for pre-adjusting a boot safety binding on an alpine ski, including programming the principle for releasing the binding which establishes the actual release threshold, Sr, as a function of the duration of application of the forces, so that:

if the duration Δt of the application of forces E is greater than one second, 1 s, the actual release threshold, Sr, ranges between 50% and 75% of the theoretical release threshold, St; the theoretical release threshold St can be determined for each skier as a function of his\her mass, height, level of skiing ability, and skiing type, whereby:

$$\Delta t > 1\text{ s};\ 0.75\times St \geqq Sr(\Delta t) \geqq 0.5\times St;\ \text{and that}$$

if the duration Δt of the application of forces E is less than or equal to 5 hundredths of a second, 0.05 s, the actual release threshold, Sr, is greater than or equal to 150% of the theoretical release threshold, St; whereby:

$$\Delta t \leqq 0.05\text{ s};\ Sr(\Delta t) \geqq 1.5\times St;$$

BRIEF DESCRIPTION OF DRAWINGS

The invention will be better understood upon reading the following description, with reference to the attached drawings, and in which.

DETAILED DESCRIPTION OF THE INVENTION

The International Organization for Standardization (ISO) has drawn up an international standard for the assembly, adjustment, and inspection of a ski/binding/boot system (ISO 11088). This standard specifies procedures particularly intended for retailers of sporting goods for assembling and adjusting ski binding mechanisms.

The ISO 11088 standard defines optimal, theoretical release moments as a function of the skier's weight, height, and type. For a skier weighing between 67 and 78 kg (i.e., a range of approximately 147-172 lbs), for example, it is recommended that the binding disengage and release the boot when the value of the moment of the forces to which the boot is subjected is such that the component along the z-axis (vertical axis) reaches 50 N.m. (i.e., approximately 36.8 ft.-lbs.).

Binding manufacturers conform to standards and, in order to facilitate the adjustment operation carried out by technicians, they mark their products with scales graduated between 2 and 20 that correspond to the pre-adjustment of the springs of the binding elements. In this case, the indicator value on the graduated scale corresponds to 10% of the release moment along the z-axis. In other words, if a binding is "adjusted to 5", it must release when the boot is subjected to a moment of 50 N.m. along the z-axis (vertical axis).

This adjustment is modified as a function of the sole length and of the type of ski, which leads to an upward or downward adjustment of the release threshold value.

From this point forward, St, the theoretical release threshold, will refer to the release threshold that can be determined as a function of the skier's weight, the length of the boot sole, and the level of his/her skiing ability, while conforming to the standard-based recommendations.

Figure 1:
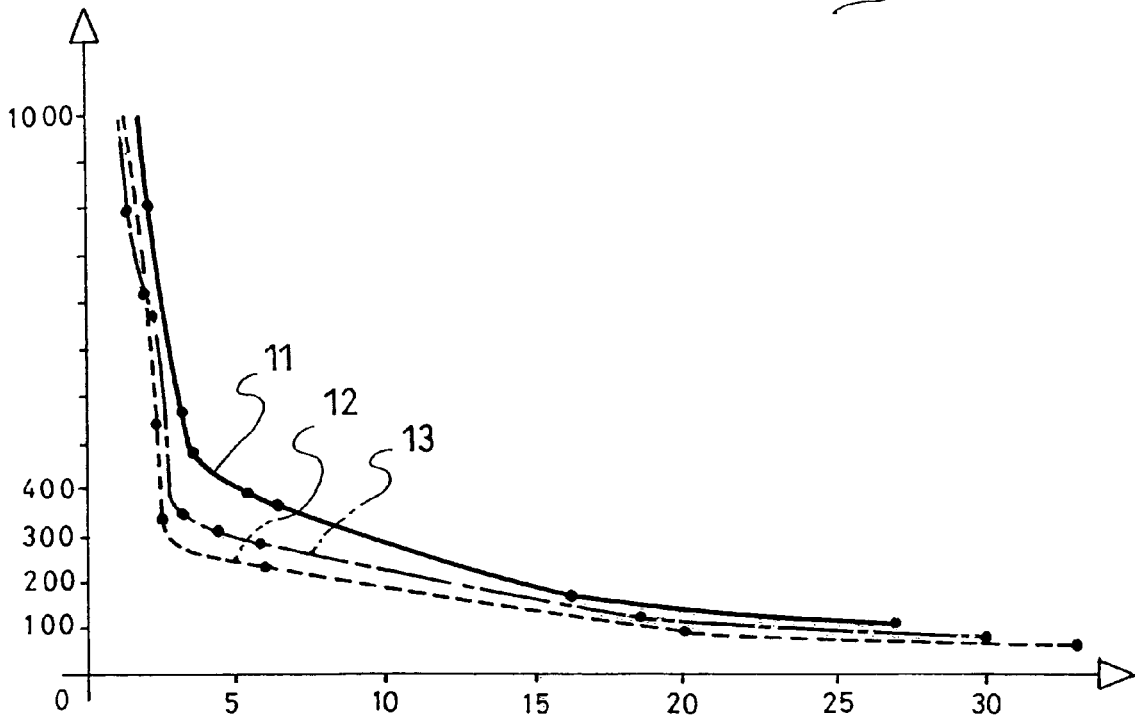
FIG. 1 is a comparative diagram of safety binding release curves according to the prior art.

FIG. 1 shows a comparative diagram of the release curves of various conventional mechanical bindings, which were commercially available in 2002, including the Salomon S 914 release curve or curve 11; the Marker M 9.1 or curve 12; and the Tyrolia PS racing or curve 13. All of these bindings include a toe piece and a heel piece, which release against the force of one or several springs. All the bindings are adjusted to DIN 9, meaning that according to the ISO 11088 standard, the theoretical release threshold St is about 90 N.m. (i.e., approximately 66.4 ft.-lbs.).

This diagram shows, on the x-axis, the duration of the application of force in milliseconds, and on the y-axis, the force in Newtons. The results illustrated in this diagram were achieved by means of a test machine which operates by applying forces at a distance of 0.9 m (i.e., approximately 2.95 feet) from an axis located in the same position as the skier's leg.

This diagram shows that as soon as the duration of impact exceeds 30 ms (0.03 s), the actual release threshold is almost at the level of the theoretical release threshold, St, commonly referred to as "the DIN".

Considering the behavior of conventional mechanical ski bindings, one understands that the problems of ill-timed releases, for example when the forces to which the boot is subjected last less than 50 ms (0.05 s), are not resolved.

Figure 2:
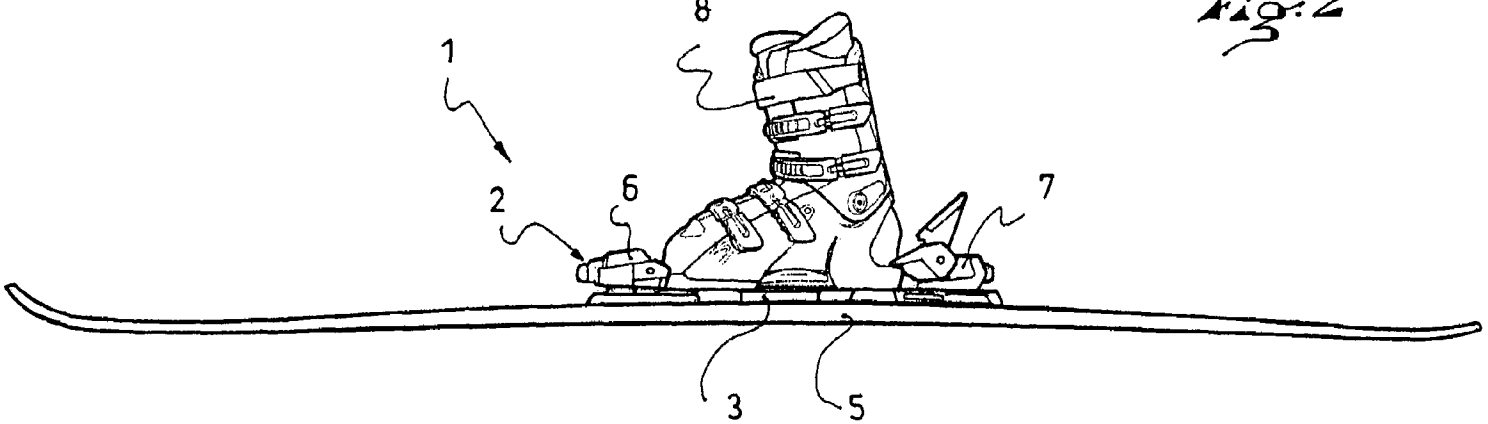
FIG. 2 illustrates an embodiment of a safety binding according to the invention.

FIG. 2 illustrates an embodiment of the invention. The binding device 1 is fixed to the ski 5 and has mechanisms 2 for retaining the boot 8 which are in the form of a toe piece 6 and a heel piece 7. The binding device also has a force-detection mechanism 3. There are also a decision mechanism (not shown), which can be an electronic module, between the detection and retaining mechanisms. The release principle for the binding device is programmed inside this decision module.

Figure 2A:
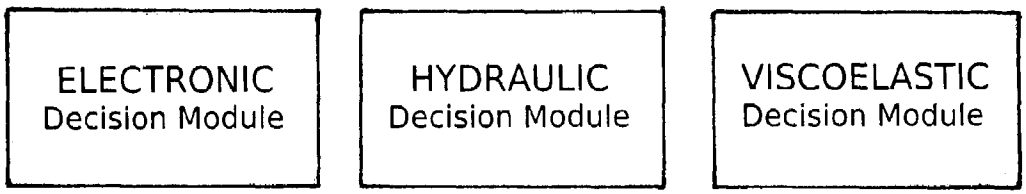
FIG. 2*a* schematically illustrates alternative decision modules of a binding according to the invention.

The invention is not limited to a binding device having a decision module of the electronic type. In addition to the electronic type, FIG. 2*a* schematically illustrates alternative embodiments, in which the decision module could be of a hydraulic type or a viscoelastic type. The hydraulic type, for example, can take the form of a hydraulic jack positioned parallel to the main spring of a toe piece or a heel piece. When forces are applied for a very brief period of time, the damper blocks the spring movement, thus preventing the release. The hydraulic jack can be advantageously replaced by a viscoelastic material. In such embodiments, the force detection, the decision and the release command are indissociable from one another because they are all carried out by the main spring and the cylinder or the viscoelastic material.

Figure 3:
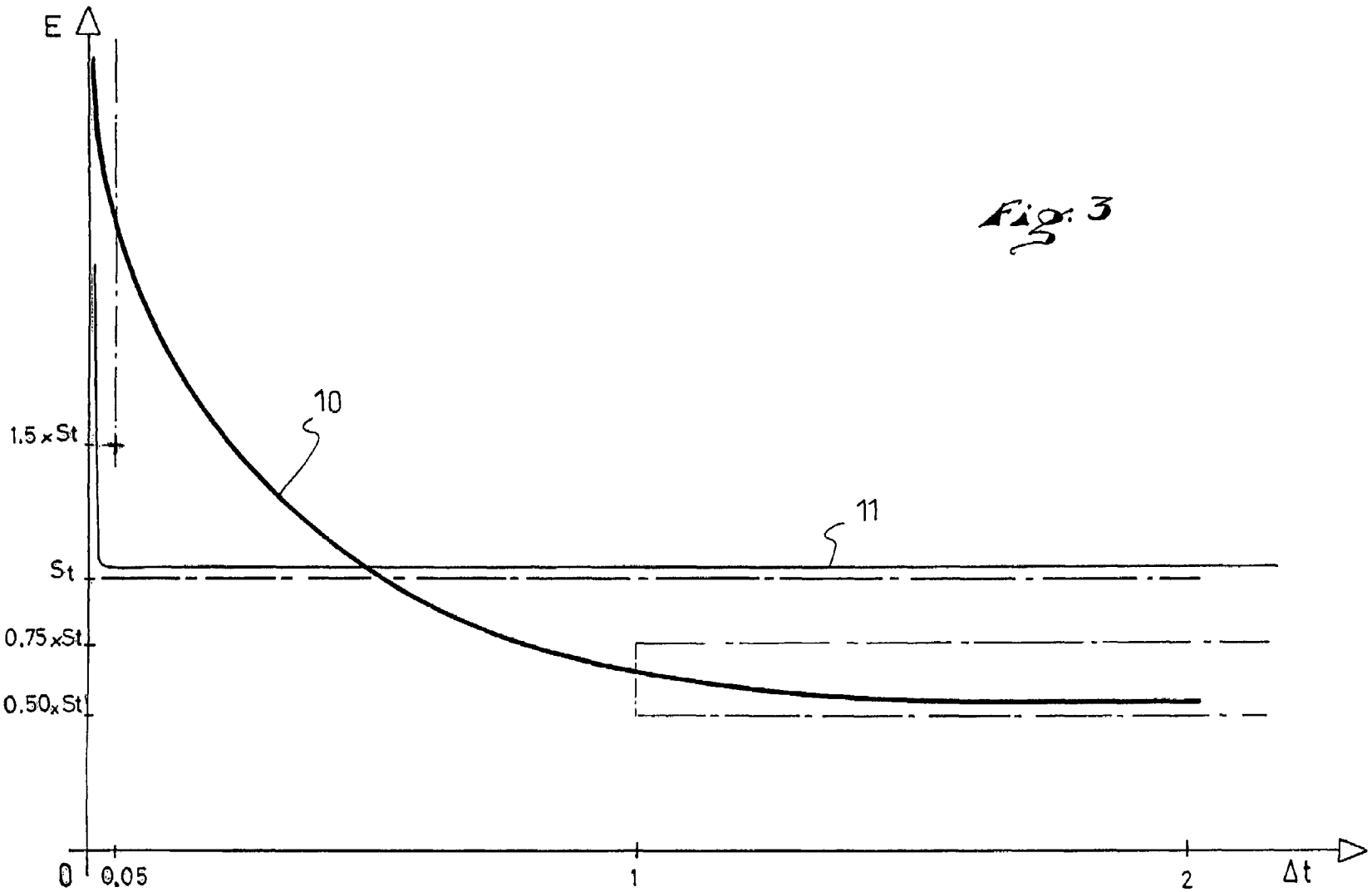
FIG. 3 is a graph defining the scope of the release principle according to the invention.

FIG. 3 is a diagram showing the zones of the release principle according to the invention. The release principle Sr(Δt), represented by the curve 10 in this diagram, defines an actual release threshold Sr as a function of the duration Δt of the application of forces.

The release principle Sr(Δt) is of the exponential decrease type, which is mathematically expressed as follows:

$$Sr(\Delta t) = a + e^{-\frac{\Delta t + b}{c}}$$

or, using another typography:

$$Sr(\Delta t)=a+exp[(b-\Delta t)/c]$$

The parameters a, b, and c are chosen so that the release principle remains within the zones defined by the present invention.

In particular, if the duration of application is greater than one second, 1 s, the actual release threshold, Sr, ranges between 50% and 75% of the theoretical release threshold, St, whereby:

$$\Delta t>1\ s;\ 0.75\times St \geqq Sr(\Delta t) \geqq 0.5\times St$$

Furthermore, if the duration Δt of the application of forces is less than or equal to 5 hundredths of a second, 0.05 s, the actual release threshold, Sr, is greater than or equal to 150% of the theoretical release threshold, St; whereby:

$$\Delta t \leqq 0.05\ s;\ Sr(\Delta t) \geqq 1.5\times St$$

The invention also is directed to protecting a method of pre-adjusting a boot safety binding on an alpine ski. This method involves programming a release principle, Sr (Δt) for the binding, which establishes the actual release threshold, Sr, as a function of the duration Δt of the application of forces E, this principle being of the exponential decrease type: Sr(Δt) =a+exp[(b−Δt)/c], whereby the parameters a, b, and c are set as a function of the weight, height, and skiing type selected, such that:

$$\Delta t>1\ s;\ 0.75\times St \geqq Sr(\Delta t) \geqq 0.5\times St;\ \text{and}$$

$$\Delta t \leqq 0.05\ s;\ Sr(\Delta t) \geqq 1.5\times St;$$

The invention is not limited to a programming principle that is exactly of the exponential type, as approximations of such a principle are also covered by the instant invention insofar as the release principle remains within the zones defined by the invention.

LIST OF ELEMENTS

1—binding device
2—retaining mechanism
3—detection mechanism
5—ski
6—toe piece
7—heel piece
10—release principle Sr (Δt)
11—release principle Salomon S 914
12—release principle Marker M 9.1
13—release principle Tyrolia PS racing

The invention claimed is:

1. A safety binding device for binding a boot on an alpine ski, said binding device comprising:

a releasable retaining mechanism for the boot, said retaining mechanism being actuable to a release position in response to a force to which the boot is subjected;

said releasable retaining mechanism comprising an arrangement to detect the force to which the boot is subjected while the boot is retained by said releasable retaining mechanism;

an electronic circuit controlling said release of said releasable retaining mechanism by generating a release command as a function of a detected magnitude of said force and as a function of a duration Δt of force;

said release occurring in response to said detected magnitude of said force being greater than an actual release threshold Sr;

said release threshold being dependent upon the duration Δt of force;

said duration Δt of force being greater than one second;

the actual release threshold Sr being comprised between 50% and 75% of a theoretical release threshold St, whereby:

$$\Delta t > 1 \text{ second}; 0.75 \times St \geqq Sr(\Delta t) \geqq 0.5 \times St;$$

the theoretical release threshold St is determined as a function of a skier's parameters in conformance with ISO standards.

2. A binding device according to claim 1, wherein:

the releasable retaining mechanism comprises a type of mechanism selected from a group consisting of mechanical, hydraulic, and viscoelastic.

3. A method for using the safety binding of claim 1, said method comprising:

pre-adiusting the safety binding on an alpine ski comprising programming a release principle of said binding, thereby establishing an actual release threshold Sr as a function of a duration Δt of forces to which a boot is subjected, whereby if the duration Δt of forces is greater than one second, the actual release threshold Sr is comprised between 50% and 75% of a theoretical release threshold St, said theoretical release threshold St being determined for a skier as a function of the skier's weight, height, and skiing type, whereby:

$$\Delta t > 1 \text{ second}; 0.75 \times St \geqq Sr(\Delta t) \geqq 0.5 \times St.$$

4. A method according to claim 3, wherein:

said release principle is programmed such that if the duration Δt of forces is less than or equal to 0.05 second, the actual release threshold Sr is greater than or equal to 150% of the theoretical release threshold St, whereby:

$$\Delta t > 0.05 \text{ second}; Sr(\Delta t) \geqq 1.5 \times St.$$

5. A method according to claim 3, wherein:

an actual release threshold is defined by the release principle as a function of time, Sr(Δt);

the release principle is of the following exponential decrease type:

Sr(Δt)=a +exp [(b−Δt)/c], where a, b, and c are parameters set as a function of a skier's weight, height, and skiing type.

6. A binding device according to claim 1, wherein:

said release command is generated upon detection of a lesser magnitude of force when said duration Δt of force is greater than one second than when said duration Δt of force is less than one second.

7. A safety binding device for binding a boot on an alpine ski, said binding device comprising:

a releasable retaining mechanism for the boot, said retaining mechanism being actuable to a release position in response to a force to which the boot is subjected;

said releasable retaining mechanism comprising an arrangement to detect the force to which the boot is subjected while the boot is retained by said releasable retaining mechanism;

an electronic circuit controlling said release of said releasable retaining mechanism by generating a release command as a function of a detected magnitude of said force and as a function of a duration Δt of force;

said release occurring in response to said detected magnitude of said force being greater than an actual release threshold Sr;

said release threshold being dependent upon the duration Δt of force;

said duration Δt of force being less than or equal to 0.05 second;

the actual release threshold Sr being greater than or equal to 150% of a theoretical release threshold St, whereby:

$$\Delta t < 0.05 \text{ second}; Sr(\Delta t) \geqq 1.5 \times St;$$

the theoretical release threshold St is determined as a function of a skier's parameters in conformance with ISO standards.

8. A binding device according to claim 7, wherein:

the releasable retaining mechanism comprises a type of mechanism selected from a group consisting of mechanical, hydraulic, and viscoelastic.

9. A binding device according to claim 7, wherein:

said release command is generated upon detection of a lesser magnitude of force when said duration Δt of force is greater than one second than when said duration Δt of force is less than one second.

10. A safety binding device for binding a boot on an alpine ski, said binding device comprising:

a releasable retaining mechanism for the boot, said retaining mechanism being actuable to a release position in response to a force to which the boot is subjected;

said releasable retaining mechanism comprising an arrangement to detect the force to which the boot is subjected while the boot is retained by said releasable retaining mechanism;

an electronic circuit controlling said release of said releasable retaining mechanism by generating a release command as a function of a detected magnitude of said force and as a function of a duration Δt of force;

an actual release threshold being defined by a release principle as a function of time, Sr(Δt);

the release principle tush being of the following exponential decrease type:

$Sr(\Delta t)=a+\exp[(b-\Delta t)/c]$, where a, b, and c are parameters.

11. A binding device according to claim 1, wherein:

the releasable retaining mechanism comprises a type of mechanism selected from a group consisting of mechanical, hydraulic, and viscoelastic.

12. A binding device according to claim 10, wherein:

said release command is generated upon detection of a lesser magnitude of force when said duration $\Delta t$ of force is greater than one second than when said duration $\Delta t$ of force is less than one second.

* * * * *